US006072394A

United States Patent [19]

Hasegawa et al.

[11] Patent Number: 6,072,394

[45] Date of Patent: Jun. 6, 2000

[54] RESONANCE CIRCUIT TAG, METHOD FOR PRODUCTION THEREOF AND METHOD FOR CHANGING RESONANCE CHARACTERISTIC THEREOF

[75] Inventors: Yoshitsugu Hasegawa; Hiroshi Yamamoto; Hiroshi Wada; Toshiharu Konishi; Naoki Matsuoka, all of Ibaraki, Japan

[73] Assignee: Nitto Denko Corporation, Osaka, Japan

[21] Appl. No.: 08/608,740

[22] Filed: Feb. 29, 1996

[30] Foreign Application Priority Data

Mar. 3, 1995 [JP] Japan ..... 7-044616
Aug. 22, 1995 [JP] Japan ..... 7-213826

[51] Int. Cl.[7] ..... G08B 13/14

[52] U.S. Cl. ..... 340/572; 29/25.42; 361/314

[58] Field of Search ..... 340/572; 361/314–319; 29/25.42, 825; 428/901

[56] References Cited

U.S. PATENT DOCUMENTS 3,913,219 10/1975 Lichtblau ..... 29/592
4,797,785 1/1989 Jorgensen ..... 361/402
4,952,609 8/1990 Fukushima et al. ..... 521/94
5,059,950 10/1991 Perchak ..... 340/572
5,108,822 4/1992 Imaichi et al. ..... 340/572 X
5,126,192 6/1992 Chellis et al. ..... 428/901 X
5,182,544 1/1993 Aquilera et al. ..... 340/572
5,257,009 10/1993 Narlow ..... 340/572
5,447,779 9/1995 Imaichi et al. ..... 428/901 X

FOREIGN PATENT DOCUMENTS 2211702 7/1989 United Kingdom .

*Primary Examiner*—Thomas Mullen
*Attorney, Agent, or Firm*—Sughrue, Mion, Zinn, Macpeak & Seas, PLLC

[57] ABSTRACT

The present invention provides a resonance circuit tag that comprises an insulating substrate and a resonance circuit formed on the substrate. Additionally, the resonance circuit contains at least a capacitor and an inductor. Further, a dielectric of the capacitor satisfies at least either being foamable by heating or being capable of changing its thickness by not less than 10% by heating. The resonance circuit of the present invention also provides various advantages in that it can easily cease functioning, it does not inhibit labor-saving and speedy operation at the cash register, it facilitates large-scale production, and it eliminates degradation of the function of the article to which the tag has been attached.

18 Claims, 5 Drawing Sheets

RESONANCE CIRCUIT TAG, METHOD FOR PRODUCTION THEREOF AND METHOD FOR CHANGING RESONANCE CHARACTERISTIC THEREOF

FIELD OF THE INVENTION

The present invention relates to a resonance circuit tag used for preventing shoplifting. More particularly, the present invention relates to a resonance circuit tag which can be manufactured easily, can be produced in large numbers and which is highly reliable in that it ensures easy termination of the function of the resonance circuit without impairing the function of articles to which the resonance circuit tag has been attached, production thereof and a method for changing the resonance characteristic thereof.

BACKGROUND OF THE INVENTION

A resonance circuit tag having a circuit which resonates with a certain wave frequency has been used for preventing shoplifting in libraries and diverse kinds of stores such as those selling books, CDs, video tapes and the like, supermarkets and department stores. Various attempts have been made to provide an economical, compact and high quality resonance tag, as reported in Japanese Utility Model Unexamined Publication Nos. 54038/1973 and 75585/1973, and Japanese Patent Unexamined Publication Nos. 23395/1989, 130490/1987 and 200297/1988.

A resonance circuit tag is required not to function after the price of an article has been paid at a check-out counter, and to this end, the tag is usually removed from the article at the check-out counter. However, recent demand for a labor-saving and speedy operation of cash registers as achieved by the introduction of bar codes, etc. cannot be fully met due to the troublesome step of removing a resonance circuit tag attached to the article.

To overcome such disadvantage, a so-called self-breakdown type resonance circuit tag has been proposed which loses its resonance function by the application of heat and other methods. Specific examples thereof include a resonance circuit tag wherein a soluble link is formed in its circuit, which melts upon application of energy having a self-breakdown frequency, thereby breaking the circuit (U.S. Pat. No. 3,913,219) and a resonance circuit tag prepared from an electrically insulating sheet composed of a thermoplastic resin, etc. wherein a high frequency current is generated by applying a strong high frequency wave having a resonance frequency, by which said insulating sheet is deformed or melted to cause defective insulation, resulting in the functional termination of the resonance circuit (Japanese Patent Unexamined Publication No. 266700/1987).

In the self-breakdown tag of the type mentioned above, the the resonance function can be terminated by, for example, passing the tag on an article through a high frequency inductor; thus, and the aforementioned labor-saving, speedy operation of cash registers are not impaired.

Of the above-exemplified resonance circuit tags, the former is associated with a problem in that a large-scale production is difficult to achieve by a conventional circuit-forming technique such as etching, since part of the circuit needs to be formed more narrowly than the remainder.

On the other hand, the latter resonance circuit tag has a risk of adversely affecting the function of an article to which the tag has been attached, as a result of the considerably strong high frequency wave having a resonance frequency which is applied to the resonance circuit to deform or melt the insulating sheet composed of a thermoplastic resin. It may also suffer from insufficient self-breakdown function due to sufficient deformation of the insulating sheet.

SUMMARY OF THE INVENTION

It is therefore an object of the present invention to provide a resonance circuit tag which can be manufactured easily, can be produced in large numbers and which ensures easy termination of the function of the resonance circuit with reduced occurrence of impairment of the function of the article to which the resonance circuit tag has been attached.

Another object of the present invention is to provide a production method useful for manufacturing the above-mentioned resonance circuit tag.

Yet another object of the present invention is to provide a new resonance circuit tag manufactured by the above-mentioned production method.

A further object of the present invention is to provide a method for ensuring easy change of resonance characteristic of a resonance circuit tag without impairing the function of an article having the resonance circuit tag.

The resonance circuit tag of the present invention has at least a resonance circuit including a capacitor and an inductor formed on an insulating substrate, wherein a dielectric of the capacitor meets at least one of the following requirements:

(a) being foamable by heating (b) being capable of changing its thickness by not less than 10% by heating.

The method for producing the resonance circuit tag of the present invention comprises laminating either a primary circuit having at least an inductor and a first capacitor electrode or a secondary circuit having a second capacitor electrode on an insulating support, and laminating the remaining circuit on the obtained laminate via an adhesive layer.

In another embodiment of the resonance circuit tag of the present invention, the tag comprises a primary circuit having at least an inductor and a first capacitor electrode and a secondary circuit having at least a second capacitor electrode laminated via a dielectric layer, wherein either the first or the second circuit is laminated on an insulating support, and the remaining circuit is laminated on the resulting laminate via an adhesive layer. This adhesive layer may meet the requirements mentioned above.

The method for changing the resonance characteristic of the resonance circuit tag of the present invention comprises heating the resonance circuit tag by induction heating or some other method.

DETAILED DESCRIPTION OF THE INVENTION

Figure 1:
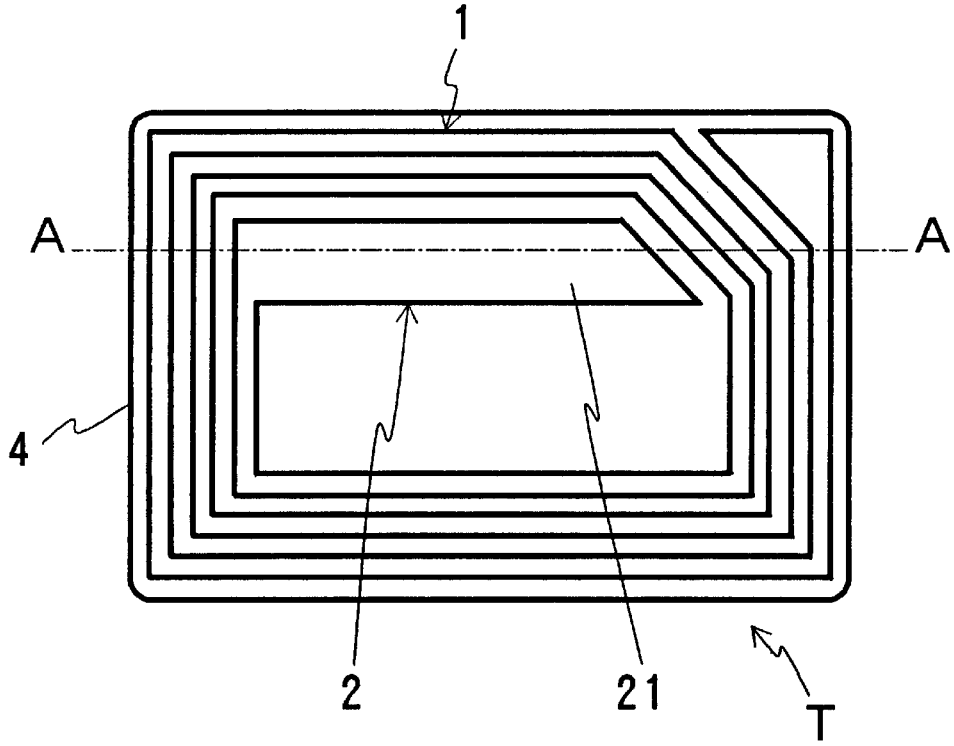
FIG. 1 is a schematic plane view showing one embodiment of the resonance circuit tag of the present invention.
Figure 2:
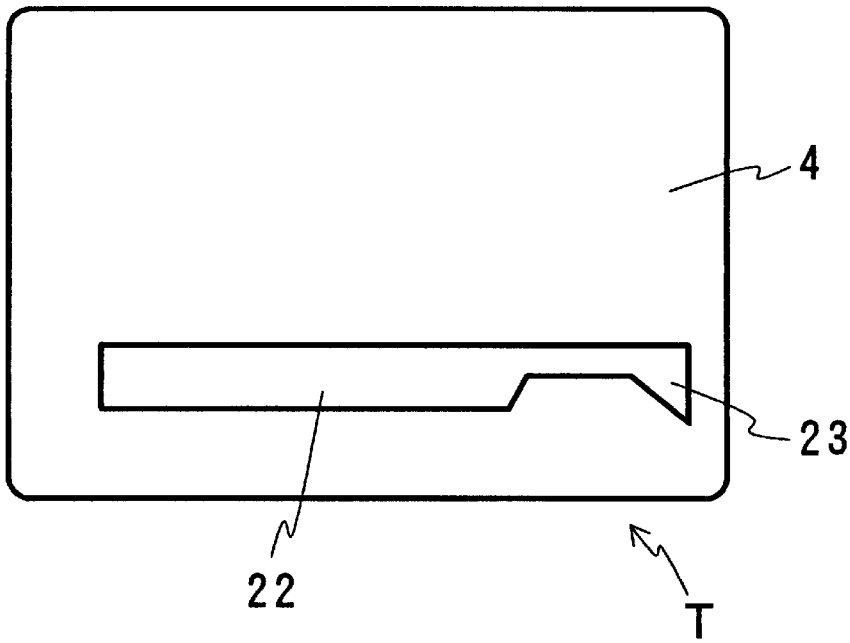
FIG. 2 is a bottom View of the resonance circuit tag shown in FIG. 1.
Figure 3:
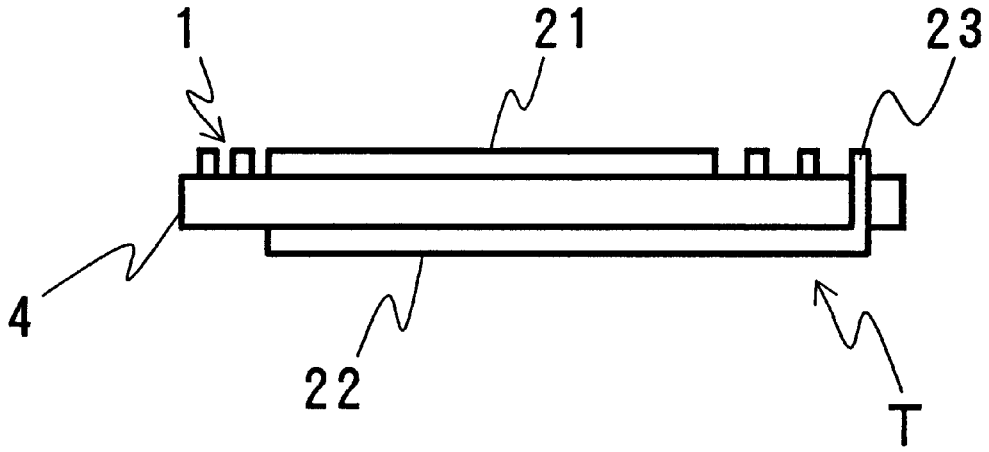
FIG. 3 is a sectional view along the line A—A of the resonance circuit tag shown in FIG. 1.

The resonance circuit tag of the present invention comprises a resonance circuit having at least a capacitor and an inductor formed on an insulating substrate. This structure is obtained by, for example, laminating a conductive layer, an insulating layer and a conductive layer in that order and etching the conductive layers of the resulting laminate to form circuits. FIG. 1 is a plan view showing one embodiment of such resonance circuit tag; FIG. 2 is a bottom view of the resonance circuit tag shown in FIG. 1; and FIG. 3 is a sectional view at line A—A of the resonance circuit tag shown in FIG. 1. A resonance circuit tag T shown in FIGS. 1–3 comprises a resonance circuit composed of a capacitor 2 having electrodes 21 and 22 and an inductor 1, which is formed on an insulating substrate 4. The circuits formed on the both sides of the above-mentioned insulating substrate 4 assume conductivity via a conducting path 23. In this embodiment, the insulating substrate (insulating layer) 4 simultaneously acts as an insulator of the inductor 1 and a dielectric of the capacitor 2. The present invention is described in more detail by referring to the embodiment shown in FIG. 1.

In the present invention, the dielectric of the capacitor is prepared from a material meeting at least one requirement of (a) being foamable by heating and (b) being capable of changing its thickness by not less than 10% by heating. In the embodiment of FIG. 1, the insulating substrate 4 is composed of such a material.

In a resonance circuit, the size and the number of turns of an inductor are predetermined to permit resonance with a wave having a particular wave frequency, and the capacitance is limited. With regard to the capacitance, the precision of the capacitor dielectric is considered to be particularly critical. When the permissible difference of the wave frequency is 3%, that of the dielectric thickness is 5% at maximum. In the case of a dielectric having a thickness of 25 $\mu$m, for example, the permissible difference of the thickness thereof is 1.25 $\mu$m at maximum. A large-scale production of resonance circuit tags by, for example, conventional extrusion laminating at this level of precision requires a precise (considerably high) technique. To put it reversely, a variation in the thickness of dielectric beyond the permissible difference leads to the corresponding variation in capacitance to cause changes in resonance frequency beyond the permissible range, as a result of which the resonance circuit tag loses its function with regard to the predetermined frequency. The present invention utilizes this phenomenon to the self-breakdown function of the resonance circuit tag. To be specific, the present invention has been accomplished by using, as a dielectric, a material satisfying at least one of the requirements of (a) being foamable by heating and (b) being capable of changing its thickness to the extent fully beyond the permissible range, and heating the dielectric to cause changes in the thickness, thereby to ensure easy termination of the function of the resonance circuit tag.

The dielectric having the heat foamability as defined in (a) above is obtained by, for example, adding a foaming agent to the material constituting the insulating substrate (dielectric) 4. Upon heating, the insulating substrate 4 foams to easily change its thickness.

The material constituting the above-mentioned insulating substrate may be any material as long as it can change its thickness by the action of the foaming agent to be added, and includes, for example, polyolefins such as polyethylene and polypropylene, and various resins and rubbers such as polyvinyl chloride, polyester, polyamide, polyisobutylene, polybutene, butyl rubber and ethylene-propylene rubber. In the case of extrusion forming, polyolefin is appropriately used, since it allows easy forming.

The foaming agent to be contained in the above-mentioned insulating substrate is subject to no particular limitation, and one or more known foaming agents can be used.

Examples of preferable foaming agents include organic foaming agents such as diazo compounds and nitroso compounds. The diazo foaming agent is exemplified by azodicarbonamide and foaming agents containing same [CELLMIKE C (trade mark, manufactured by SANKYOU KASEI CO., LTD.) and VINYHOLE AC (trade mark, manufactured by EIWA KASEI CO., LTD.)] and nitroso foaming agent is exemplified by N,N'-dinitrosopentamethylenetetramine [CELLULAR D (trade mark, manufactured by EIWA KASEI CO., LTD.) and CELLMIKE A (trade mark, manufactured by SANKYOU KASEI CO., LTD.)].

As the foaming agent, heat-expandable particles obtained by capsulating the gasified components of butane, propane, pentane and the like may be also used, which are preferable in that mixing is easily done. Examples of the particulate heat-expandable foaming agent are MATSUMOTO MICROSPHERE (trade mark, manufactured by MATSUMOTO YUSHI-SEIYAKU CO., LTD.) obtained by microcapsulating butane gas using acrylonitrile-vinylidene chloride copolymer as capsules, and EXENPEARL (trade mark, manufactured by NIPPON FILLITE CO., LTD.). A co-foaming agent may be used as necessary.

When the insulating substrate is prepared by extrusion forming, the above-mentioned foaming agent preferably has a decomposition temperature of not less than 80° C., preferably 120–200° C. When the decomposition temperature of the foaming agent is not less than 80° C., decomposition of the foaming agent due to the heat during preparation of the insulating substrate occurs to a lesser extent, which is desirable in terms of handling property. In addition, the laminating speed is free of limitation, since it is not necessary to lower the forming temperature in accord with the decomposition temperature of the foaming agent. This is advantageous in that the production time will not be prolonged and an increase in production costs can be avoided. When the decomposition temperature of the foaming agent is not more than 200° C., the resonance circuit tag can cease functioning without application of excessive heat, thus decreasing influence on articles. Such a foaming agent is exemplified by the above-mentioned diazo foaming agents and nitroso foaming agents. In particular, diazo foaming agents have a decomposition temperature of about 180–200° C., which is higher than the temperature for forming an insulating substrate by extrusion (e.g., about 150° C. in case of polyethylene) and is preferable in the present invention.

The foaming agent is desirably contained in an amount of about 0.1–10 parts by weight, preferably 1–5 parts by weight relative to 100 parts by weight of the material constituting the insulating substrate, so that the extent of change in the thickness of the insulating substrate (dielectric) 4 may fall within the suitable range to be mentioned later.

In the present invention, the thickness of the dielectric desirably changes by not less than 10%, preferably about 10–200%, and more preferably about 50–100%, as defined in (b) above.

Figure 4:
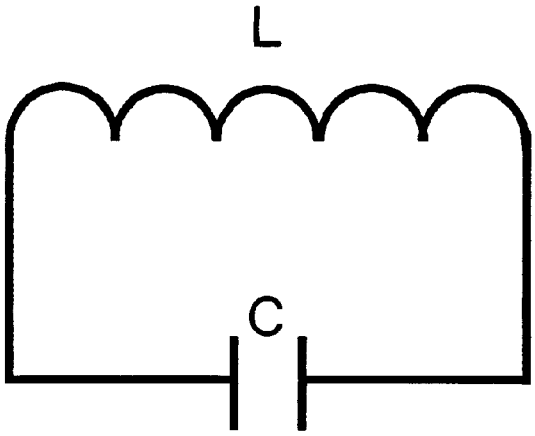
FIG. 4 shows one embodiment of a resonance circuit tag.

For example, when the resonance circuit is as shown in FIG. 4, the resonance condition of this circuit is expressed by the formula:

$$f=\frac{1}{2\pi}(LC)^{1/2} \quad (1)$$

wherein f is resonance frequency, L is inductance of inductor and C is capacitance. The capacitance C is expressed by the formula:

$$C=\epsilon\cdot S/d \quad (2)$$

wherein $\epsilon$ is dielectric-constant, S is electrode area and d is the thickness of dielectric. The inductance L of the inductor is in proportion to the outer diameter R2 and the square of the number N of turns of the inductor, and expressed by the formula:

$$L=10^{-7}a\cdot R2\cdot N^2 \quad (3)$$

wherein a is a function of the ratio (R1/R2) of the inner diameter R1 to the outer diameter R2 of the inductor [see *Denki Kogaku Handbook, Denki Gakkai* ed., pp 110–111 (1988)]. From the above formulas (1) and (2), the following is obtained:

$$f^2=\frac{1}{4\pi^2}LC=d/(\epsilon\cdot S4\pi^2L)$$

Accordingly, the formula:

$$d=\epsilon\cdot S4\pi^2Lf^2 \quad (4)$$

is the obtained. Supposing d1 is initial thickness of the dielectric before change, d2 is the thickness of the dielectric after change, f1 is the resonance frequency before the thickness change and f2 is the resonance frequency after the thickness change, the following formula is obtained from the above formula (4):

$$d2/d1=(f2/f1)^2$$

Accordingly, the formula:

$$f2=(d2/d1)^{1/2}\cdot f1 \quad (5)$$

Supposing the variation in dielectric thickness to be +10%, the following is obtained:

$$d2=1.1\times d1$$

From the above formula (5), $$f2=(1.1)^{1/2}\cdot f1=1.049f1$$

and the resonance frequency change is 4.9%.

As mentioned earlier, the variation of 4.9% in the resonance frequency when the permissible difference of wave frequency is about 3% makes resonance of the circuit difficult with respect to the frequency f1. Consequently, a change in thickness of the dielectric of not less than 10% brings sufficient variation in resonance frequency to cause breakdown of the resonance circuit tag T.

A thickness variation of the dielectric of not less than 200% requires addition of a large amount of a foaming agent which tends to cause great influence on the dielectric constant.

The material constituting the resonance circuit having the above-mentioned inductor 1 and the capacitor 2 is not particularly limited as long as it possesses conductivity. For example, various metals such as aluminum, copper, nickel and tin, and various alloys containing these as main components can be used. In consideration of conductivity, cost and processability, aluminum is preferably used.

The thickness of the conductor of the inductor 1 and the thickness of the conductor of the electrodes 21 and 22 of the capacitor 2 is suitably about 9–50 $\mu$m in consideration of resistance, processability and cost, though somewhat different depending on the kind of material to be used.

Note that at least one of the above-mentioned electrodes 21 and 22 can be formed to be brittle to allow the insulating substrate (dielectric) 4 to break the electrodes when it changes its thickness by heating. In this way, self-breakdown of the resonance circuit can be ensured. Such a brittle electrode can be prepared by, for example, forming a thin electrode (e.g., about 5–12 $\mu$m).

The size of inductor 1 and the electrode area of the capacitor 2 are determined according to the resonance frequency. The planar shape of the above-mentioned inductor 1 and the electrode area of the capacitor 2 is optional and may be circular, square or elliptical, besides the polygon shown in FIG. 1.

The above-mentioned inductor 1 is suitably a planar eddy coil as shown in FIGS. 1–3, since the resonance circuit tag is generally formed into a sheet.

The number of turns of the inductor 1 is generally 5–10, preferably 7–9, though somewhat different depending on the size of the inductor. When the number is not less than 5, the sensitivity of the resonance circuit becomes superior and when it is not more than 10, the inductor 1 does not become excessively elaborate and can be formed easily.

The resonance circuit tag T as shown in FIG. 1 can be obtained by, for example, laminating a conductive layer, an insulating layer and a conductive layer in that order and etching the conductive layers of the resulting laminate to form circuits, as mentioned earlier.

The laminate of the aforementioned insulating layer and the conductive layers can be prepared, for example, by forming a mixture of an insulating material such as polyethylene and a diazo foaming agent into a sheet by extrusion and laminating a metallic foil such as aluminum foil on the both faces thereof, or by a method comprising adding a foaming agent to a dispersion obtained by heat-melting the above-mentioned insulating material in a solvent such as toluene and heptane, applying this dispersion to a metallic foil, drying and evaporating the solvent. When an insulating material is prepared in a solution as in the latter method, polyisobutylene, polybutene, butyl rubber and ethylene-propylene rubber can be also used as the insulating material, since they can dissolve in a solvent such as toluene and heptane.

The conductive layer can be prepared by evaporating a metallic material, besides using a metallic foil. For example, such a layer can be formed by evaporation of various metallic materials such as aluminum, copper, nickel and tin on an insulating sheet by sputtering or vacuum evaporation. This method enables decreasing the thickness of the resonance circuit tag T and permits easy processing, which in turn leads to the reduction of the production cost of the resonance circuit tag T. It should be noted, however, that the conductive layer obtained by evaporation has greater electric resistance, and the evaporation is preferably applied when forming a secondary circuit having a second capacitor electrode 22, rather than a primary circuit having inductor 1 and a first capacitor electrode 21.

Figure 5:
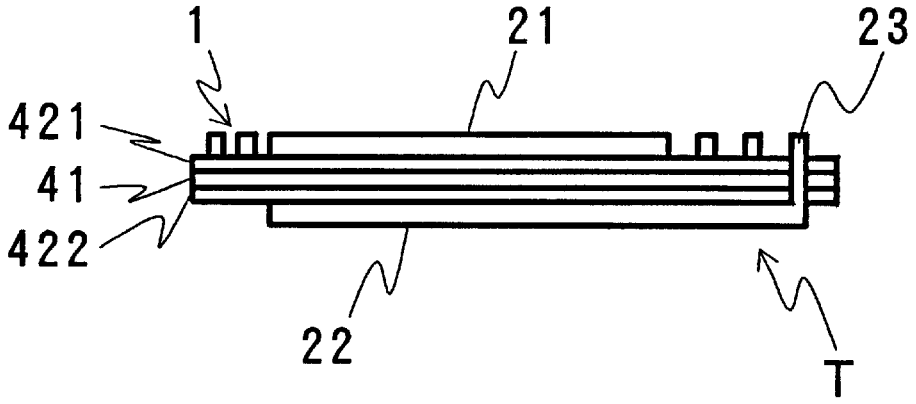
FIG. 5 is a schematic sectional view of another embodiment of the resonance circuit tag of the present invention.

Alternatively, an adhesive layer is formed on at least one surface of the insulating sheet. When the adhesive layer is formed on one surface alone, a foaming agent is contained therein. When the adhesive layer is formed on both surfaces, a foaming agent is contained in at least one of the layers. Then, the conductive layers are formed on both surfaces of the insulating sheet. FIG. 5 shows a schematic section of one embodiment of a resonance circuit tag prepared using such a laminate. In the resonance circuit tag T shown in FIG. 5, adhesive layers 421 and 422 are formed on the both surfaces of an insulating sheet 41 and both the adhesive layers 421 and 422 contain a foaming agent. In this case, the insulating sheet 41 is preferably composed of a resin having superior resistance to heat during etching a metallic foil. Examples of such resins include polyesters such as polyethylene terepthalate, and polypropylene. Examples of the adhesive layers 421 and 422 include hot melt adhesives such as polyethylene, SBS (styrene-butadiene-styrene block copolymer), SIS (styrene-isoplene-styrene block copolymer) and modified polymers thereof, pressure sensitive adhesives and adhesives made from natural rubber or synthetic rubber, acrylic adhesives, urethane adhesives and epoxy adhesives, all of which are capable of adhering at normal temperature or upon heating.

When a foaming agent is contained in the above-mentioned insulating material solution or adhesive layer, an insulating substrate can be prepared without exposing the foaming agent to a high temperature. Hence, a foaming agent having a lower decomposition temperature than do diazo and nitroso foaming agents, such as those having a decomposition temperature of about 60–150° C., preferably about 80–120° C., can be also used. This offers advantages in that the function of the resonance circuit tag can be terminated by the application of relatively weak heat and the influence on articles caused by heating can be lessened. Examples of such foaming agents having lower decomposition temperature include the aforementioned heat-expandable particles such as MICROSPHERE.

The method of etching the conductive layer is known, such as a method comprising printing a circuit pattern on the conductive layer by silk screen printing, forming a layer for protecting from etching, applying etching using an etching solution and removing the etching protection layer by a solvent.

While the resonance circuit consists of one inductor and one capacitor in the embodiment of FIG. 1, the use of a capacitor divided into an even number of parts thereof is preferred.

Figure 6:
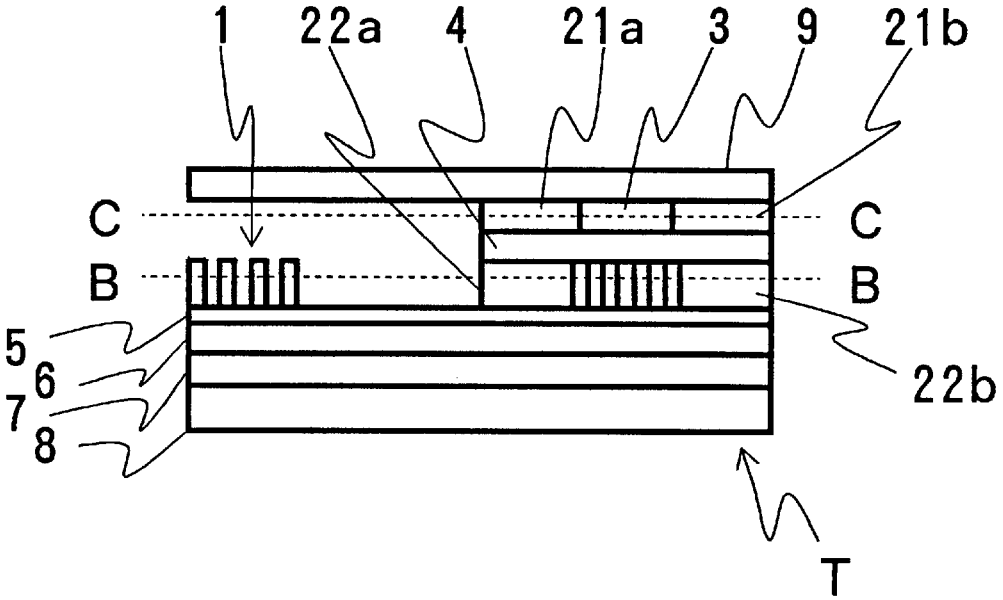
FIG. 6 is a schematic sectional plane view showing still another embodiment of the resonance circuit tag of the present invention.
Figure 7:
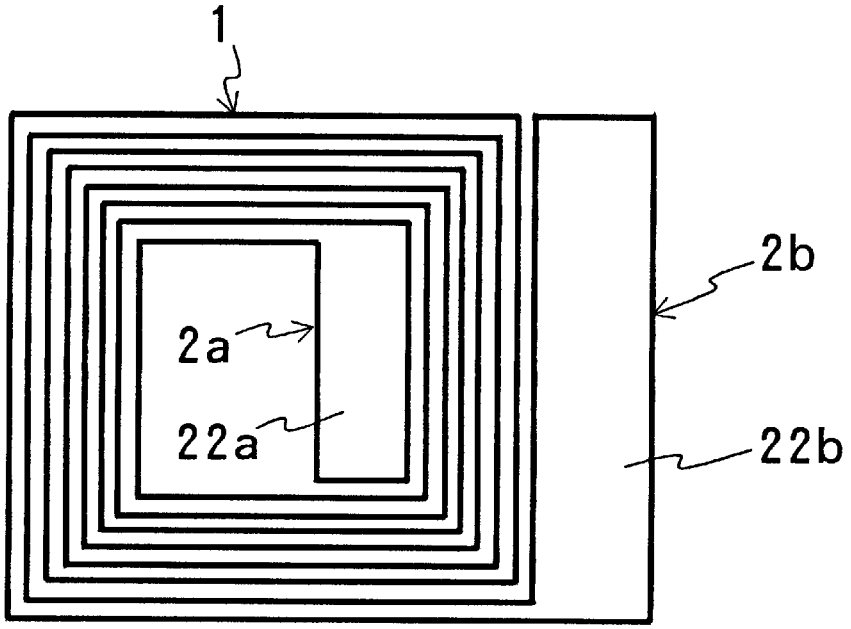
FIG. 7 is a sectional view along the line B—B of the resonance circuit tag shown in FIG. 6.
Figure 8:
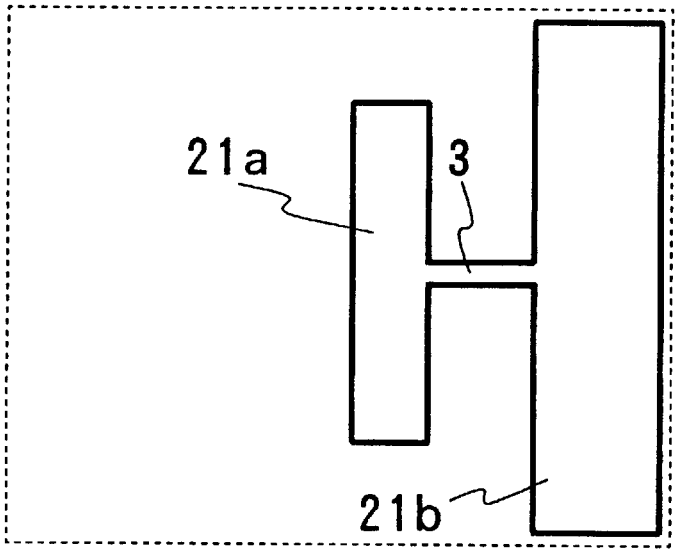
FIG. 8 is a sectional view along the line C—C of the resonance circuit tag shown in FIG. 6.
Figure 9:
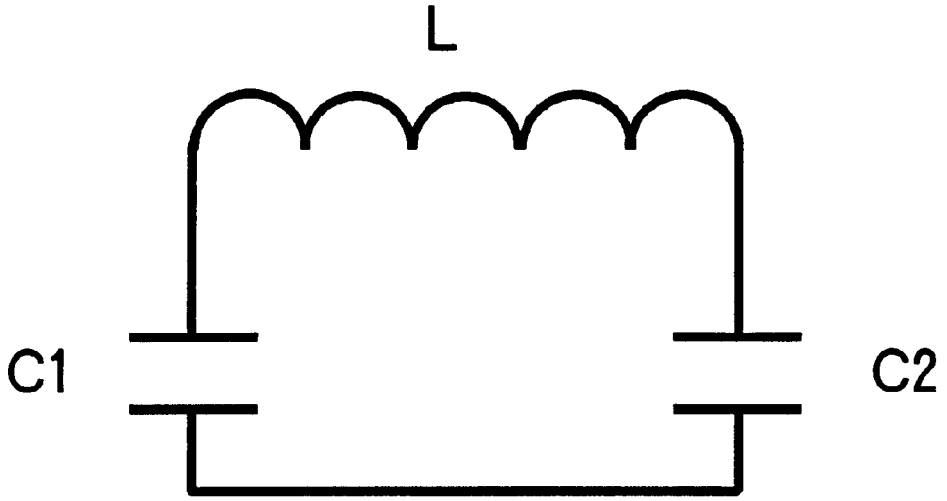
FIG. 9 shows an equivalent circuit diagram of the resonance circuits shown in FIGS. 6–8.

FIG. 6 shows a schematic vertical cross section of one embodiment of a resonance circuit tag having such a resonance circuit. FIG. 7 is a cross section along the line B—B of the resonance circuit tag of FIG. 6. FIG. 8 is a cross section along the line C—CB—B of the resonance circuit tag of FIG. 6. Note that FIG. 7 and FIG. 8 show the resonance circuit tag of FIG. 6 when it is not split vertically. In this embodiment of FIG. 6, the resonance circuit consists of one inductor 1 and two capacitors 2*a* and 2*b*. In FIG. 6, 6 is a support to hold the circuit of FIG. 7, 5 is an adhesive layer to adhere the circuit to the support 6, 7 is an adhesive layer to adhere the resonance circuit tag 7 to an article, 8 is a releasing layer to protect the adhesive layer 7 and 9 is a cover permitting printing of bar codes and trade marks. FIG. 9 shows an equivalent circuit diagram of the resonance circuit tag T shown in FIGS. 6–8.

In general, an odd number of capacitors used for creating a resonance circuit require conducting each circuit formed on the both surfaces of the insulating substrate by ultrasonic welding and the like. When a resonance circuit is formed using an even number of capacitors, the circuit stands without conducting the circuits on the both surfaces of the insulating substrate. In the embodiment shown in FIGS. 6–8, a capacitor 2*a* consisting of electrodes 21*a* and 22*a* respectively formed on the upper surface and lower surface of an insulating substrate 4, is formed on the inner portion of the inductor 1; a capacitor 2*b* consisting of electrodes 21*b* and 22*b* respectively formed on the upper surface and lower surface of the insulating substrate 4, is formed on the outer portion of the inductor 1; and the electrodes 21*a* and 21*b* are connected at the joint 3, whereby the resonance circuit having the circuit diagram of FIG. 9 is created without conducting the circuits on the upper surface and the lower surface of the insulating substrate 4. This construction obviates conducting of the circuits and facilitates production of the resonance circuit tag, which in turn reduces production cost, conduction failure and malfunction.

When an even number of capacitors are used as mentioned above, the number is preferably as small as possible to stabilize the resonance characteristic of the circuit and simplify the structure for easy manufacture of the circuit. For example, two capacitors are preferably used as shown in FIGS. 6–8.

The resonance circuit tag of the present invention can be also created by laminating either a primary circuit having an inductor and a first capacitor electrode or a secondary circuit having a second capacitor electrode on an insulating substrate and laminating the remaining circuit on the resulting laminate via an adhesive layer.

To be more specific, when a resonance circuit tag having a structure similar to that shown in FIGS. 6–8 is to be manufactured, a primary circuit (inductor 1 and first capacitor electrode 22) is laminated on a support 6 and a secondary circuit (second capacitor electrode 21) having an adhesive layer 4 is adhered to said primary circuit.

When an insulating support 6 for holding the circuit is formed separately from the insulating substrate 4 as a dielectric layer to have circuits formed on both surfaces thereof, the insulating substrate can be prepared from an adhesive alone. Examples of such adhesives include the adhesive used for adhesive layer 421 or 422 shown in FIG. 5, which contains a foaming agent.

According to the production method as described above, for example, an adhesive layer is formed on one of the primary and the secondary circuits to give a tape circuit which is adhered to the mating circuit formed on the support to give a resonance circuit tag. This method obviates etching of the conductive layers on the both surfaces of a substrate, thereby facilitating the production of a resonance circuit tag.

The above-mentioned method provides the following resonance circuit tag.

That is, a resonance circuit tag wherein a primary circuit having an inductor and a first capacitor electrode and a secondary circuit having a second capacitor electrode are laminated via a dielectric layer (adhesive layer), wherein one of the primary circuit and the secondary circuit is laminated on an insulating support and the remaining circuit is laminated on the resulting laminate via an adhesive layer.

Such a resonance circuit tag desirably has a construction wherein a primary circuit (inductor 1 and first capacitor electrode 22) is laminated on a support 6 and a secondary circuit (second capacitor electrode 21) is laminated on said primary circuit via an adhesive layer 4, as shown in FIGS. 6–8. This adhesive layer also acts as a dielectric of the capacitor consisting of the first capacitor electrode 22 and the second capacitor electrode 21.

Examples of such adhesive include the adhesive used for adhesive layer 421 or 422 shown in FIG. 5, which contains a foaming agent.

This construction obviates etching of the conductive layers on the both surfaces of the substrate, so that the production is facilitated and the production cost is reduced.

It is desirable that at least one side of the resonance circuit tag thus obtained be colored or printed in black, white, etc., or adhered with paper having a bar code, a pattern mark of the store, an advertisement and the like, or a label made from plastic (e.g., polyester, polypropylene and polyvinyl chloride) or synthetic paper, or the support or circuit face be directly colored or printed in black, white, etc., to conceal the circuit patterns, whereby to hide that the tag has a resonance circuit, namely, the tag is attached for the prevention of shoplifting. Alternatively, an adhesive layer 7 of natural rubber, synthetic rubber, etc. known per se may be formed on one side of the resonance circuit tag, as shown in FIG. 6, so that the tag can be adhered to an article.

The size of the resonance circuit tag is preferably as small as possible and the area thereof is desirably about 9–25 $cm^2$. Smaller resonance circuit tags can be attached to a large number of articles and can reduce production cost, since the material cost becomes less.

To decrease the size of the resonance circuit tag, the inductor may be made smaller. In this case, the value R2 in the above-mentioned formula (3) becomes smaller, and the inductance L of the inductor also becomes smaller. Then, the number N of turns of the inductor is increased so that L is not reduced even when R2 decreases. However, a smaller outer diameter of an inductor and larger number of turns necessitate elaborate etching and punching, making the circuit difficult to form. When the capacitance C in the formula (1) is increased, the resonance frequency f can be made constant even if L is made smaller. C can be increased by either enlarging the electrode area S of the capacitor or reducing the thickness d of the dielectric or increasing the dielectric constant $\epsilon$. In view of the limitation imposed on the electrode area S and the thickness d, it is preferable that the dielectric constant $\epsilon$ be increased. Moreover, a dielectric constant $\epsilon$ increased to a certain extent enables decreasing the electrode area S. In this case, when the inductor has a certain size, the electrode area S of the capacitor can be reduced and the thickness d of the dielectric can be increased.

The dielectric constant $\epsilon$ of the dielectric is preferably increased by, for example, forming the insulating substrate 4 from an acrylic adhesive. The acrylic adhesives have high polarity and higher dielectric constant.

It is desirable to add a titanium compound to the dielectric in the present invention, whereby to increase the dielectric constant of the dielectric. Examples of the titanium compound include titanium oxide, barium titanate and strontium titanate, with preference given to titanium oxide and barium titanate. The titanium compound is preferably added to the dielectric in a proportion of about 10–50% by weight.

According to the present invention, the dielectric (insulating substrate) of the capacitor of the resonance circuit tag is heated to change the thickness of the dielectric while the price of an article is being paid at a check-out counter, so that the resonance characteristic of the resonance circuit tag is changed.

The heating temperature can be such as to change the thickness of the dielectric of the capacitor to a desired extent. When a dielectric containing a foaming agent is used, the temperature is not less than the decomposition temperature of the foaming agent, provided that the temperature is high enough to sufficiently foam the foaming agent and minimize the influence on the article caused by the heat.

The time necessary for heating the resonance circuit tag to the above-mentioned temperature is desirably within 1 second, more preferably within about 0.2 second, in view of the desired speedy operation at the cash register, though somewhat different depending on the heating means and the structure of the resonance circuit tag.

The method of heating is not particularly limited, and, for example, the electrode of the capacitor of the resonance circuit tag may be brought into contact with a heating plate to transmit the heat. For example, when the electrode is composed of aluminum, induction heating is preferable and when the electrode is composed of iron, eddy current heating is preferable. By these heating methods, the resonance circuit tag can be heated without coming into contact with the heating means and the heating temperature and heating time can be easily determined.

When the induction heating is employed, a heating means such as an oscillator is incorporated into a bar code reading machine or installed alongside therewith. In this way, heating of the resonance circuit tag can be done together with the usual cash register operation and the function of the resonance circuit tag can be ceased without inhibiting labor-saving, speedy operation at the check-out counter.

The present invention is described in more detail by referring to examples, to which the invention is not limited.

Preparation of resonance circuit tag

EXAMPLE 1

A mixture of polyethylene (trade mark: YUKARON LM-30, manufactured by Mitsubishi Petrochemical Company, Ltd.) and 1% by weight of azodicarbonamide (trade mark: VINYHOLE AC#3, manufactured by EIWA KASEI CO., LTD.) was extruded through a test T-die extruder, and a 50 $\mu$m thick aluminum foil and a 9 $\mu$m thick aluminum foil were laminated on the both surfaces of the sheet extruded out from the die. The thickness of the polyethylene layer in the laminate was 25 $\mu$m. Circuit patterns were printed on the both surfaces of the laminate by silk screen printing, on which an etching protection layer was provided. After etching using a solution of ferric chloride as an etching liquid, the protection layer was dissolved and removed with toluene to give circuits. The circuits on the both surfaces of the laminate were compressed and conducted by ultrasonic welding (a method described in U.S. Pat. No. 3,913,219) to give the resonance circuit tag as shown in FIGS. 1–3. A copy paper was adhered to one surface of the tag via a rubber adhesive and a releasing paper for protection was adhered to the other surface via a rubber adhesive layer.

EXAMPLE 2

In the same manner as in Example 1 except that 5% by weight of a masterbatch compound of low density polyethylene and N,N'-dinitrosopentamethylenetetramine (trade mark: POLYSLEN EE-206, manufactured by EIWA KASEI CO., LTD.) was used instead of azodicarbonamide, a resonance circuit tag was prepared.

EXAMPLE 3

A mixture of polyisobutylene (trade mark: Vistanex MML-100L, manufactured by Exon Chemical Corp.) and 0.1% by weight of a particulate heat-expandable foaming agent was dissolved in toluene to give a 10% solution. The solution was coated on a 50 $\mu$m thick aluminum foil and dried, so that the thickness after drying became 25 $\mu$m, on which a 9 $\mu$m thick aluminum foil was laminated. Using the laminate obtained, a resonance circuit tag was prepared in the same manner as in Example 1.

EXAMPLE 4

An urethane adhesive was applied to a 25 $\mu$m thick polyester film in a thickness of about 5 $\mu$m, and a 30 $\mu$m thick aluminum foil was laminated thereon. A circuit pattern was printed on the aluminum foil by silk screen printing and an etching protection layer was formed on this printing. Using a ferric chloride solution as an etching liquid, the foil was etched. The etching protection layer was dissolved and removed with toluene to give a circuit having an inductor and one electrode of the capacitor (the film with this circuit is referred to as pattern A). On the other hand, a styrene-isoplene-styrene block copolymer (100 parts by weight, trade mark CARIFLEX TR-1107, manufactured by SHELL CHEMICAL CO., LTD.) and petroleum resin (80 parts by weight, trade mark ARKON M-100, manufactured by ARAKAWA CHEMICAL CO., LTD.) were dissolved in toluene, and azodicarbonamide (trade mark VINYHOLE SE#30, manufactured by EIWA KASEI CO., LTD.) was added in a proportion of 1% by weight. The mixture was applied to a 9 μm thick aluminum foil so that the thickness after drying became 30 μm and dried at 100° C. for 5 minutes. Then, the adhesive side was covered with a silicone-treated releasing paper and this laminate was punched into the shape of the other electrode of the capacitor (this is referred to as pattern B). The pattern B was laminated with the electrode portion of the pattern A to give a resonance circuit having two capacitors which was the same as the circuit shown in FIGS. 7 and 8. A 20 μm thick natural rubber adhesive layer was formed on the polyester film side and was covered with a releasing paper for protection. An adhesive paper label was adhered to the 9 μm thick aluminum foil on the electrode side to make same printable, whereby a resonance circuit tag which was the same as the tag shown in FIG. 6 was prepared.

EXAMPLE 5

A hot melt adhesive of a styrene-isoplene block polymer was dissolved in toluene and N,N'-dinitrosopentamethylenetetramine (trade mark CELLULAR GX, manufactured by EIWA KASEI CO., LTD.) was added in a proportion of 1% by weight. In the same manner as in Example 4 except that pattern B was prepared using this adhesive solution, a resonance circuit tag was created.

EXAMPLE 6

In the same manner as in Example 4 except that a particulate heat-expandable foaming agent (trade mark MATSUMOTO MICROSPHERE, manufactured by MATSUMOTO YUSHI-SEIYAKU CO., LTD.) was used instead of azodicarbonamide, a resonance circuit tag was created.

EXAMPLE 7

In the same manner as in Example 6 except that titanium oxide (10% by weight) was further added to the adhesive solution for pattern B and the thickness of the adhesive layer was set to 25 μm, a resonance circuit tag was created.

EXAMPLE 8

In the same manner as in Example 4 except that a 38 μm thick polyester film colored in black was used instead of the 25 μm thick polyester film, a resonance circuit tag was created.

EXAMPLE 9

In the same manner as in Example 6 except that a 25 μm thick polyester film having aluminum evaporated thereon in 2 μm thickness was used instead of the 9 μm thick aluminum foil having pattern B, a resonance circuit tag was created.

COMPARATIVE EXAMPLE 1

In the same manner as in Example 1 except that a foaming agent was not added to polyethylene, a resonance circuit tag was created.

COMPARATIVE EXAMPLE 2

In the same manner as in Example 3 except that a foaming agent was not added to polyisobutylene, a resonance circuit tag was created.

COMPARATIVE EXAMPLE 3

In the same manner as in Example 4 except that a foaming agent was not added to the adhesive solution, a resonance circuit tag was created.

COMPARATIVE EXAMPLE 4

In the same manner as in Example 5 except that a foaming agent was not added to the adhesive solution, a resonance circuit tag was created.

Heating of resonance circuit tag

The resonance circuit tags obtained in Examples and Comparative Examples were heated according to the method and the conditions shown in Table 1. As the induction heater, used was Carpet Jointer T-500 (trade mark, manufactured by SINANO ELECTRIC CO., LTD.). In the Table, DPT means N,N'-dinitrosopentamethylenetetramine and SIS means styrene-isoplene-styrene block copolymer.

Evaluation of resonance circuit tag

The thickness of the insulating substrate of the resonance circuit tags obtained in Examples and Comparative Examples was measured after heating. The resonance frequency before and after the heating was measured using a dip meter. The results are shown in Table 1.

TABLE 1

| | | | Heat treatment | | | Thickness of insulating substrate (μm) | | Thickness change (%) | Resonance frequency (MHz) | |
|---|---|---|---|---|---|---|---|---|---|---|
| | Insulating substrate | Foaming agent | Method | Time (sec.) | Temp. (° C.) | Before heating | After heating | | Before heating | After heating |
| Ex. 1 | polyethylene | azodicarbonamide | transmission | 15 | 200 | 25 | 32 | 28 | 8 | 13 |
| 2 | " | masterbatch compound | induction | 5 | 260 | " | 34 | 36 | " | 14 |
| 3 | polyisobutyrene | particulate heat-expandable foaming agent | " | 3 | 200 | " | 46 | 84 | " | 16 |

TABLE 1-continued

| | | Insulating substrate | Foaming agent | Heat treatment Method | Time (sec.) | Temp. (° C.) | Thickness of insulating substrate (μm) Before heating | After heating | Thickness change (%) | Resonance frequency (MHz) Before heating | After heating |
|---|---|---|---|---|---|---|---|---|---|---|---|
| | 4 | SIS, petroleum resin | azodicarbonamide | " | " | " | 30 | 38 | 27 | " | 13 |
| | 5 | styrene-isoplene block polymer | DPT | " | " | " | " | 34 | 17 | " | 12 |
| | 6 | SIS, petroleum resin | particulate heat-expandable foaming agent | " | – | " | " | 50 | 67 | " | 15 |
| Com. Ex. | 1 | polyethylene | — | transmission | 15 | " | 25 | 25 | 0 | " | 8 |
| | 2 | polyisobutyrene | — | induction | 3 | " | " | " | " | " | " |
| | 3 | SIS, petroleum resin | — | " | " | " | 30 | 30 | " | " | " |
| | 4 | styrene-isoplene block polymer | — | " | " | " | " | " | " | " | " |

As detailedly described in the foregoing, the resonance circuit tag of the present invention can easily cease functioning and does not inhibit labor-saving, speedy operation at the cash register.

The circuit is free of the need to form part of the circuit narrower than the rest, which in turn facilitates production of the resonance circuit tag and enables large-scale production thereof.

The function of the resonance circuit can be terminated without applying strong high frequency waves having a resonance frequency to the resonance circuit tag, thus eliminating degradation of the function of the article to which the tag has been attached. Moreover, the dielectric can easily change its thickness to a desired extent by the application of the heat, so that the self-breakdown performance is sufficient and reliable.

The method of producing the resonance circuit tag of the present invention, which comprises laminating either a primary circuit or a secondary circuit on an insulating support and laminating the remaining circuit on the obtained laminate via an adhesive layer enables easy production of the resonance circuit tag and reduces production costs.

What is claimed is:

1. A resonance circuit tag comprising an insulating substrate and a resonance circuit formed on the substrate, said circuit having at least a capacitor and an inductor, wherein the capacitor has a dielectric foamable by heating so that its thickness is increased by not less than 10% by heating.

2. The resonance circuit tag of claim 1, wherein the dielectric of the capacitor contains a foaming agent.

3. The resonance circuit tag of claim 2, wherein the foaming agent has a decomposition temperature of not less than 80° C.

4. The resonance circuit tag of claim 2, wherein the foaming agent is a diazo foaming agent or a nitroso foaming agent.

5. The resonance circuit tag of claim 2, wherein the foaming agent is a particulate heat-expandable foaming agent obtained by capsulating a gasified component.

6. A method of producing a resonance circuit tag, which comprises laminating either a primary circuit having at least an inductor and a first capacitor electrode, or a secondary circuit having at least a second capacitor electrode, on an insulating support and laminating the remaining circuit on the obtained laminate via an adhesive layer, wherein said adhesive layer is prepared from a material foamable by heating so that its thickness is increased by not less than 10% by heating.

7. The method of claim 6, wherein a primary circuit is laminated on a support, and a secondary circuit having an adhesive layer is adhered to said primary circuit.

8. A resonance circuit tag comprising a primary circuit having at least an inductor and a first capacitor electrode, and a secondary circuit having at least a second capacitor electrode, laminated via a dielectric layer, wherein either the primary circuit or the secondary circuit is laminated on an insulating support and the remaining circuit is laminated on the obtained laminate via an adhesive layer, and wherein said adhesive layer is prepared from a material foamable by heating so that its thickness is increased by not less than 10% by heating.

9. The resonance circuit tag of claim 8, wherein the primary circuit is laminated on the support, and the secondary circuit is laminated on the primary circuit via an adhesive layer.

10. The resonance circuit tag of claim 8, wherein the support is colored or printed in a certain color.

11. The resonance circuit tag of claim 8, wherein the secondary circuit is composed of a layer obtained by evaporation of a metallic material.

12. The resonance circuit tag of claim 8, wherein the dielectric of the capacitor comprises a titanium compound.

13. The resonance circuit tag of claim 8, wherein the inductor is a planar eddy coil having a number of turns of 5–10.

14. The resonance circuit tag of claim 8, wherein the resonance circuit has a capacitor divided into an even number of parts thereof.

15. A method for changing the resonance characteristic of a resonance circuit tag, comprising heating the resonance circuit tag of claim 1.

16. A method for changing the resonance characteristic of a resonance circuit tag, comprising heating the resonance circuit tag of claim 1.

17. The method of claim 15, wherein the heating is induction heating.

18. The method of claim 16, wherein the heating is induction heating.

* * * * *